US011203878B2

(12) United States Patent
O'Connor

(10) Patent No.: US 11,203,878 B2
(45) **Date of Patent: *Dec. 21, 2021**

(54) FLOOR INSTALLATION TOOLS AND METHODS OF USE

(71) Applicant: Six 18, LLC., Schertz, TX (US)

(72) Inventor: Martin O'Connor, San Antonio, TX (US)

(73) Assignee: Six 18, LLC., Schertz, TX (US)

( * ) Notice: Subject to any disclaimer, the term of this patent is extended or adjusted under 35 U.S.C. 154(b) by 285 days.

This patent is subject to a terminal disclaimer.

(21) Appl. No.: 16/395,115

(22) Filed: Apr. 25, 2019

(65) Prior Publication Data

US 2019/0257095 A1 Aug. 22, 2019

Related U.S. Application Data

(63) Continuation of application No. 15/432,779, filed on Feb. 14, 2017, now Pat. No. 10,287,784.

(51) Int. Cl.
*E04F 21/22* (2006.01)
*B25B 27/02* (2006.01)

(52) U.S. Cl.
CPC ..... *E04F 21/22* (2013.01); *B25B 27/02* (2013.01)

(58) Field of Classification Search
CPC ..... E04F 21/22; B25B 27/02
USPC ..... 81/46; 254/11, 12
See application file for complete search history.

(56) References Cited

U.S. PATENT DOCUMENTS

| | | | | |
|---|---|---|---|---|
| 788,564 | A | 5/1905 | Thompson | |
| 847,272 | A | 3/1907 | Ayers | |
| 1,016,383 | A | 2/1912 | Wellman | |
| 1,159,963 | A | 11/1915 | Landgraf | |
| 2,654,408 | A | 10/1953 | Leslie | |
| 5,845,548 | A | 12/1998 | Nelson | |
| 6,135,521 | A * | 10/2000 | Wirth, Jr. | B27B 25/10 294/15 |
| 10,287,784 | B2 | 5/2019 | O'Connor | |
| 2006/0278046 | A1 | 12/2006 | Gargano | |
| 2018/0230700 | A1 | 8/2018 | O'Connor | |

FOREIGN PATENT DOCUMENTS

| | | | | |
|---|---|---|---|---|
| DE | 10217230 A1 * | 8/2003 | ..... | E04F 21/22 |
| EP | 1281823 A1 * | 2/2003 | ..... | E04F 15/04 |

* cited by examiner

*Primary Examiner* — Hadi Shakeri
(74) *Attorney, Agent, or Firm* — Carr & Ferrell LLP

(57) ABSTRACT

Provided herein are exemplary floor installation tools comprising a base having a total length L 2, a receded portion of the base having a length L 1, an impact edge having a vertical height H 3 and forming a right angle with the receded portion of the base, a rounded nose, the rounded nose having an internal angle of approximately sixty degrees, a strike plate forming a sixty degree angle with the rounded corner, the strike plate configured for receiving a force for transfer to the impact edge, and a handle adjacent to the strike plate, the handle mounted in a middle of the base.

11 Claims, 6 Drawing Sheets

FLOOR INSTALLATION TOOLS AND METHODS OF USE

CROSS-REFERENCE TO RELATED APPLICATIONS

The present application is a continuation of U.S. Ser. No. 15/432,779 filed on Feb. 14, 2017 and titled "Floor Installation Tools and Methods of Use," which is hereby incorporated by reference in its entirety.

FIELD OF THE TECHNOLOGY

The embodiments disclosed herein are related to floor installation tools and methods of use.

SUMMARY

Provided herein are exemplary floor installation tools comprising a base having a total length L 2, a receded portion of the base having a length L 1, an impact edge having a vertical height H 3 and forming a right angle with the receded portion of the base, a rounded nose, the rounded nose having an internal angle of approximately sixty degrees, a strike plate forming an approximately sixty degree angle with the rounded nose, the strike plate configured for receiving a force for transfer to the impact edge, and a handle adjacent to the strike plate, the handle mounted in a middle of the base.

Other exemplary embodiments include the floor installation tool having a total width of W 1, the handle having a width of W 2, the base having a plurality of pull bar slots, and the floor installation tool being of unitary construction. Additionally, the unitary construction may be formed by any of: steel, metal, cast iron, aluminum, hardened plastic, or hardened rubber. In some exemplary embodiments, a plastic version of the floor installation tool may weigh between one and two pounds and a metal version of the floor installation tool may weigh between two and six pounds.

The impact edge, according to many exemplary embodiments, is configured to fit flush against a corresponding vertical side of a flooring material and the impact edge is configured to transfer a force to the vertical side of the flooring material. The receded bottom portion of the base is configured to fit flush on a top of the flooring material and the floor installation tool includes an underlying surface contact area configured to fit flush against an underlying surface being floored. Various exemplary embodiments include a plurality of impact edges being approximately evenly separated apart in distance on a bottom of the floor installation tool.

DETAILED DESCRIPTION OF EXEMPLARY EMBODIMENTS

Provided herein are exemplary floor installation tools and methods of use. According to various exemplary embodiments, the floor installation tool is used for installing wood and laminate flooring. It sits on top of a new floor piece and away from floor glue.

Figure 1:
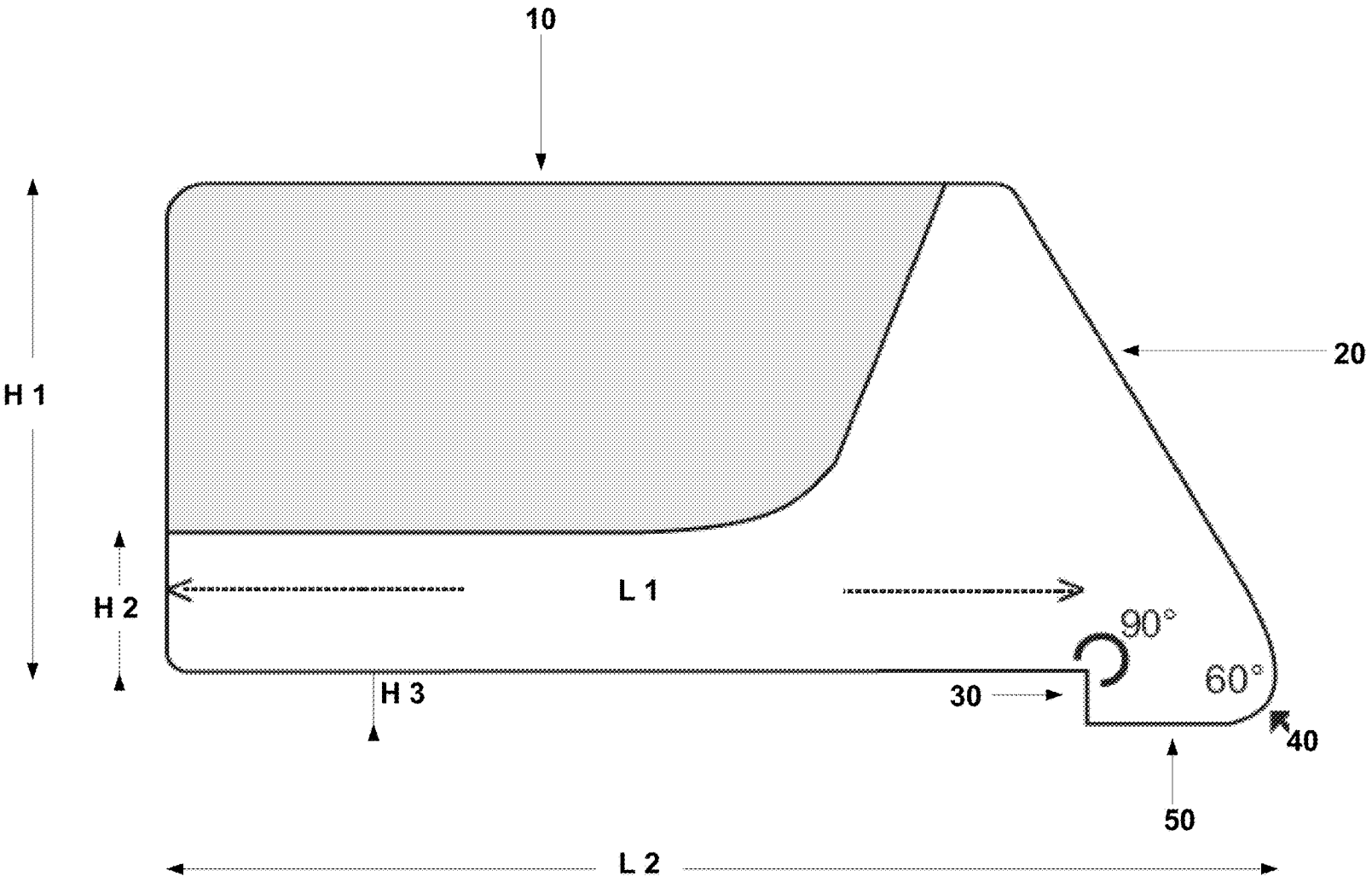
FIG. 1 is a side view of an exemplary floor installation tool.

FIG. 1 is a side view of an exemplary floor installation tool. FIG. 1 shows handle 10, strike plate 20, impact edge 30, rounded nose 40, and underlying surface contact area 50.

According to various exemplary embodiments, the floor installation tool is a unitary design of steel, metal, cast iron, aluminum, hardened plastic, hardened rubber or any other composition (or combinations thereof) capable of withstanding various forces. As shown in FIG. 1, the floor installation tool is configured for placement on top of a flooring material with the impact edge 30 fitting against the vertical side of such flooring material. As illustrated, impact edge 30 forms an approximately ninety (90) degree angle for fitting snuggly against the vertical side of flooring material that is placed flush on a horizontal surface (to be floored). Strike plate 20, according to various exemplary embodiments, has a vertical orientation of approximately sixty (60) degrees when the floor installation tool is placed on top of the flooring material with the impact edge 30 fitting against the vertical side of the flooring material. Strike plate 20 receives a force against it, such as by a hammer, mallet or other device. Upon receiving such force against the strike plate 20, impact edge 30 transfers force in the same direction as the received force against the vertical side of the flooring material to cause the flooring material to move in a horizontal direction over a surface to against either another piece of flooring material or an edge of the area where the flooring is being installed. Examples of flooring material include tongue-in-groove flooring, laminate flooring or other such flooring that is laid side by side, with or without the use of glue, nails and/or a padding surface to be placed under the flooring material.

Referring again to FIG. 1, according to some exemplary embodiments, the floor installation tool has a vertical height "H 1" of approximately one and three quarter (1.75) inches when placed on top of a section of flooring material. The floor installation tool has a corresponding horizontal length "L 2" of approximately four (4) inches. When placed on top of a section of flooring material, approximately three and one quarter (3.25) inches of a bottom surface having a horizontal length "L 1" of the floor installation tool will sit on top of the flooring material. Approximately a little less than three quarters (0.75) of an inch of a bottom surface 50 of the floor installation tool sits on top of an underlying surface which is being floored. According to some exemplary embodiments, the impact edge 30 has approximately 0.2165 inches of a vertical surface area "H 3" for contact against a side of the flooring material for the transfer of force against the flooring material. Additionally, as illustrated in FIG. 1, the floor installation tool has a rounded nose 40 that runs continuous with strike plate 20 in forming the approximately sixty (60) degree angle of strike plate 20. The floor installation tool further comprises a handle 10 that rises above the approximately half (0.5) inch base having a vertical height "H 2" of the floor installation tool and handle 10 is centered in approximately a middle of the base, forming an approximately right degree angle with strike plate 20.

According to many exemplary embodiments, the underlying surface contact area 50 fits flush against the surface being floored. Accordingly, the remaining part of the floor installation tool fits flush on top of the flooring material.

Figure 2:
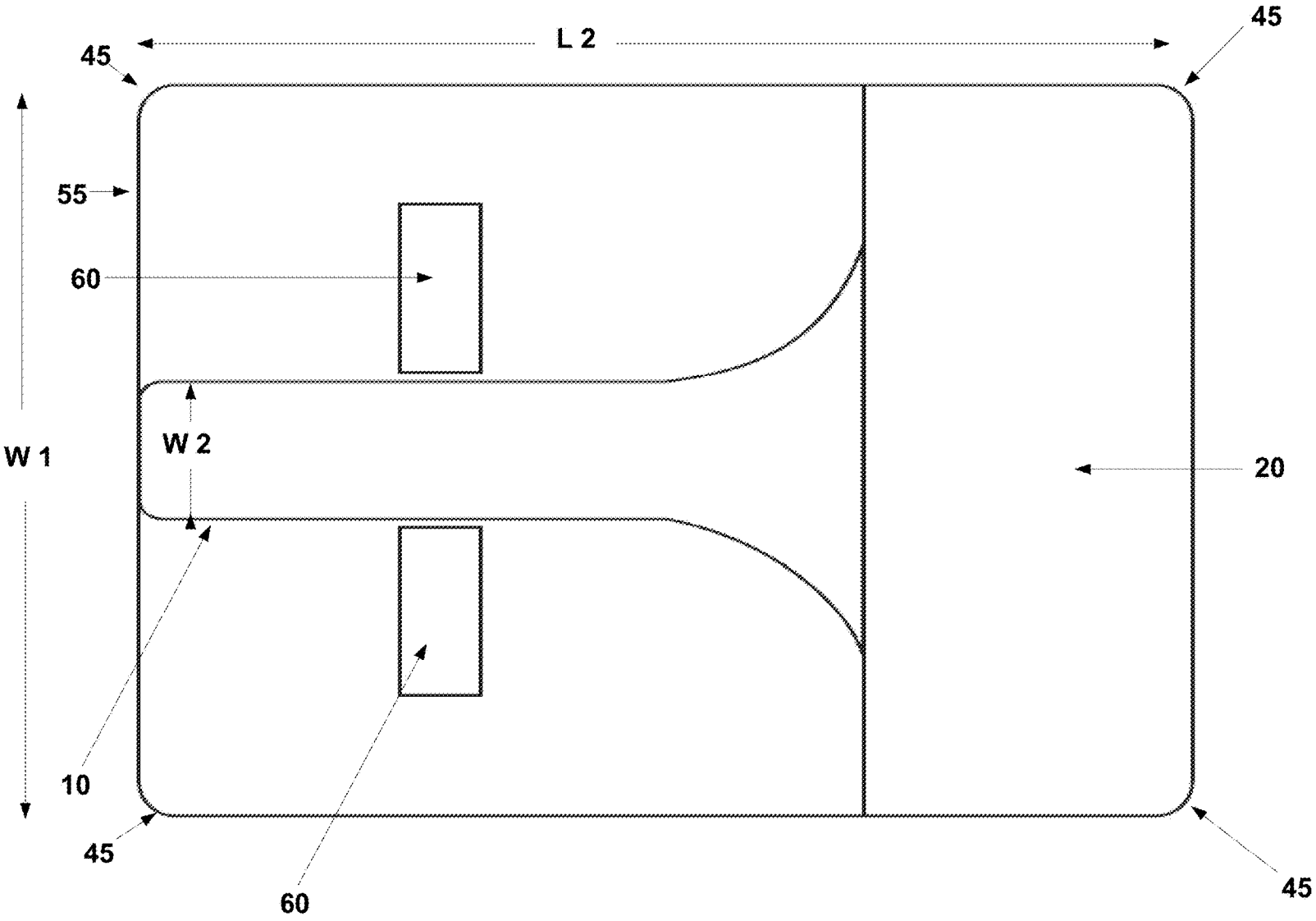
FIG. 2 is a top view of an exemplary floor installation tool.

FIG. 2 is a top view of an exemplary floor installation tool. FIG. 2 shows handle 10, strike plate 20, rounded off corners 45, indented letters 55 and pull bar slots 60.

According to various exemplary embodiments, when viewed from the top, looking down, the floor installation tool has a length "L 2" and a width "W 1" each being approximately four (4) inches. Also, from the same perspective, the handle 10 has a width "W 2" of approximately three quarters (0.75) of an inch. Pull bar slots 60 are configured to receive an end of a pull bar in the event force needs to be applied in the same direction as the force received against strike plate 20 or force needs to be applied in the opposite direction as the force received against strike plate 20.

In various exemplary embodiments, the indented letters 55 represent information such as patent marking, a part number or the like that is indented within the floor installation tool, leaving a flat outer surface.

Figure 3:
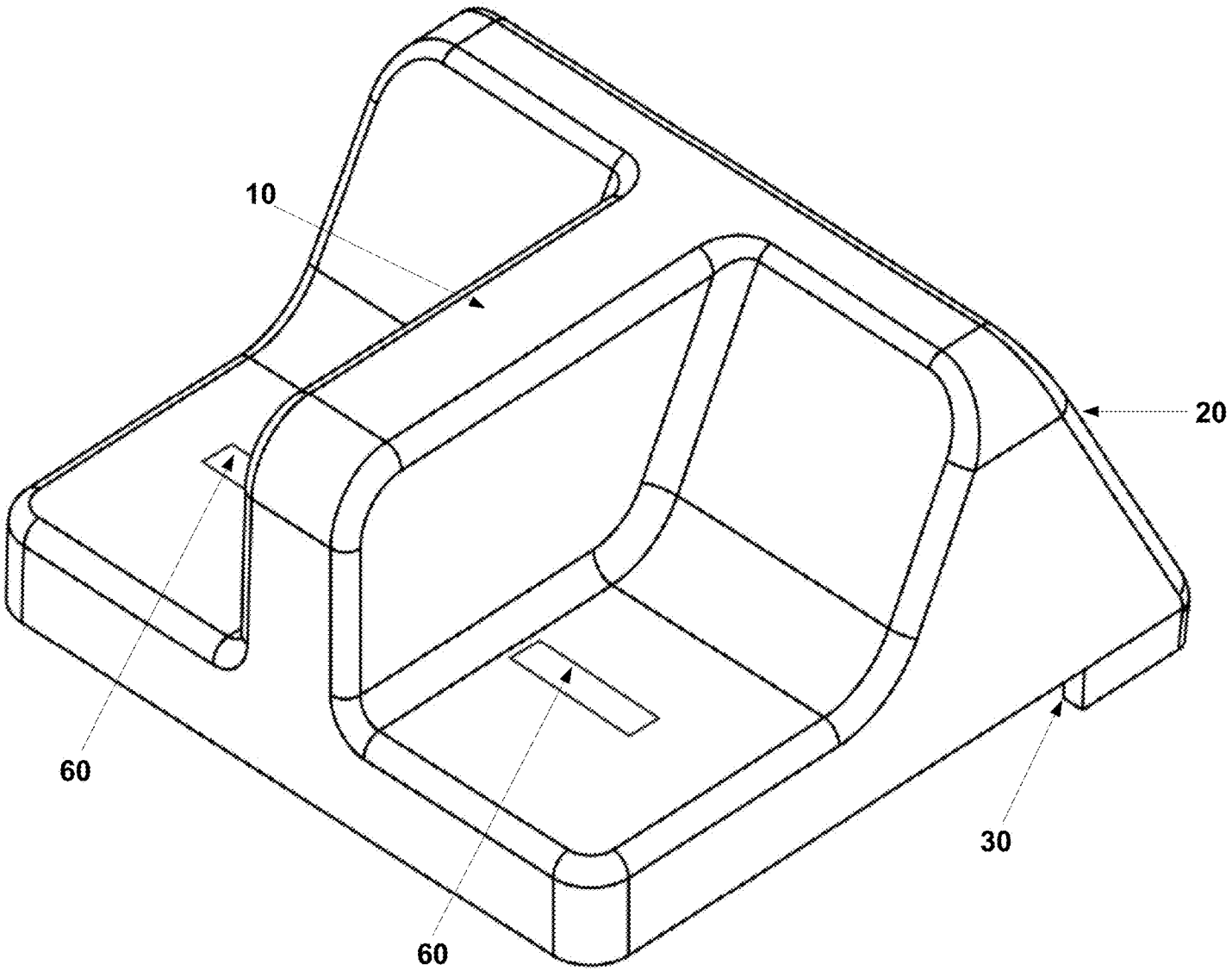
FIG. 3 is an alternative view showing a back of an exemplary floor installation tool.

FIG. 3 is an alternative view showing a back of an exemplary floor installation tool. FIG. 3 shows handle 10, strike plate 20, impact edge 30 and pull bar slots 60.

Figure 4:
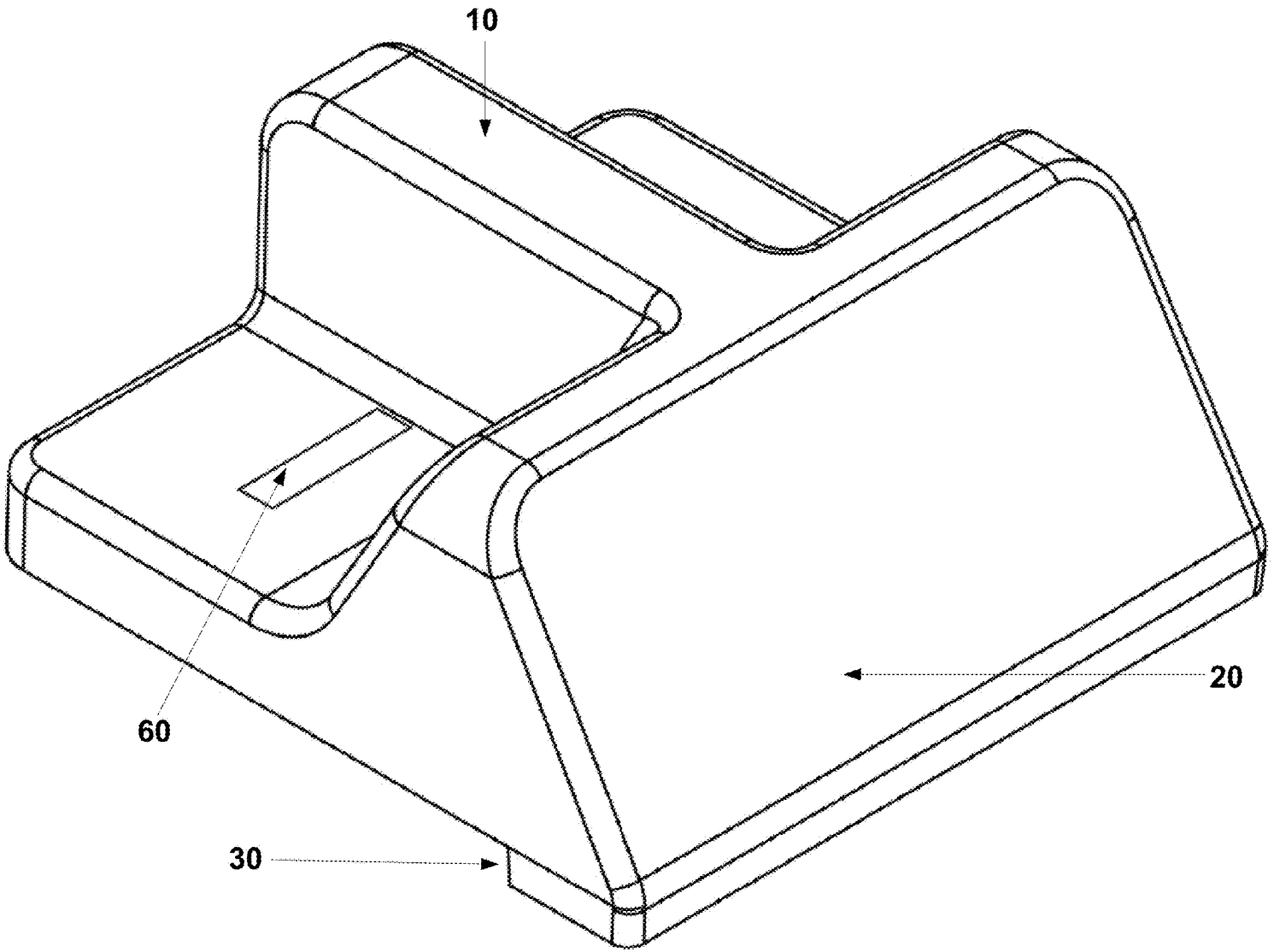
FIG. 4 is an alternative view showing a front of an exemplary floor installation tool.

FIG. 4 is an alternative view showing a front of an exemplary floor installation tool. FIG. 4 shows handle 10, strike plate 20, impact edge 30 and pull bar slot 60.

As highlighted by FIGS. 3 and 4, on both sides of the handle 10 there are "scooped out" shallow areas running from the top side, opposite of the strike plate 20, to a horizontal surface that includes the pull slots 60. The horizontal surfaces that include each of the pull slots 60 optimizes the angle at which a pull bar may be inserted for engagement and for the application of force. Additionally, in comparison to a design where these areas would be filled in with material to be flush with the top of the handle 10, the exemplary floor installation tools herein are lighter in overall weight and the weight being placed directly on top of the flooring material being installed. The advantages include an increased concentration of force from the strike plate 20 to the impact edge 30 to the vertical side of the flooring material, an increased ability to finesse the application of force from the strike plate 20 to the impact edge 30 to the vertical side of the flooring material and a decreased chance of damaging the flooring material. Further, the weight of the floor installation tool placed directly on top of the flooring material is optimized for keeping the flooring material horizontally in place during the application of force from the strike plate 20 to the impact edge 30 to the vertical side of the flooring material.

Further enabling the herein-described advantages is the approximately less than three quarters (0.75) of an inch of the bottom surface 50 (FIG. 1) of the floor installation tool that sits on top of the underlying surface that is being floored. A larger bottom surface would require a larger receded area L 1 (FIG. 1) (and a larger and heavier floor installation tool) to sit on top of the flooring material, leading to an increased chance of damaging the flooring material due to the increased mass being applied to the flooring material. Additionally, since the bottom surface 50 of the floor installation tool and a portion of the rounded nose 40 (FIG. 1) are the closest in proximity to the underlying surface being floored, a larger bottom surface of the floor installation tool would increase the chances of damaging the underlying surface being floored and increase the chances of the floor installation tool coming directly in contact with any glue or the like being used to adhere the flooring material to the underlying surface or to other flooring material.

Also enabling the herein-described advantages is the rounded nose 40 that runs continuous with strike plate 20 in forming the approximately sixty (60) degree angle of strike plate 20. Though this angle may vary in either direction by approximately ten (10) degrees or less, the angle of the application of force employed by the exemplary floor installation tools illustrated and described herein is optimized by itself and optimized to work in combination with the other aspects of the floor installation tool. For example, a ninety (90) degree strike plate would result in the application of a greater force to the impact edge 30 and to the vertical side of the flooring material, resulting in a greater chance of damage to the flooring material. These chances are even greater with a larger bottom surface area of the floor installation tool. In contrast, a ten (10) degree strike plate would result in the application of a lesser force to the impact edge 30 and to the vertical side of the flooring material, resulting in the flooring material failing to move sufficiently in a horizontal direction for installation.

Figure 5:
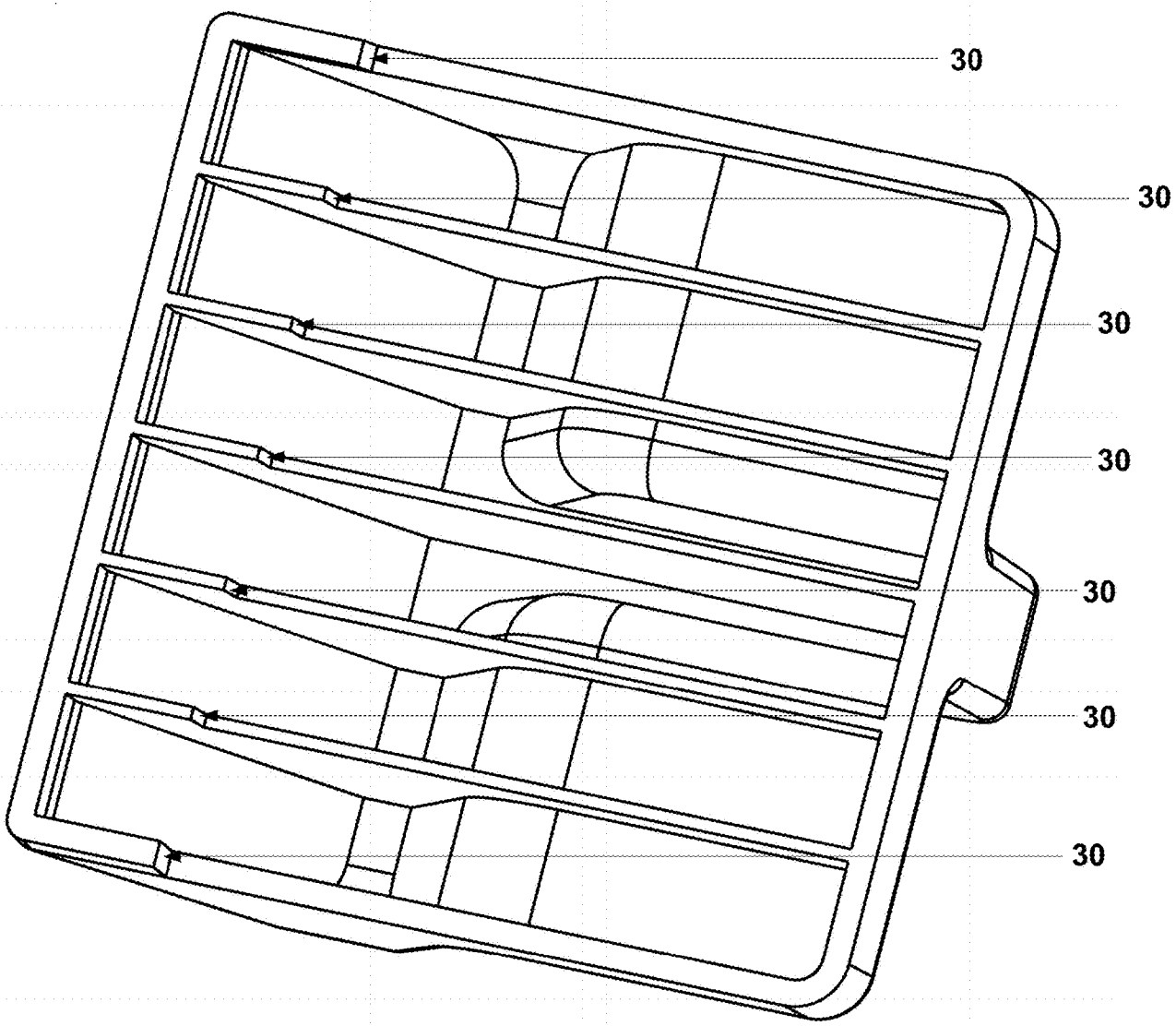
FIG. 5 is an alternative view showing a bottom of an exemplary floor installation tool.

FIG. 5 is an alternative view showing a bottom of an exemplary floor installation tool. FIG. 5 shows an underside of an exemplary floor installation tool, including a plurality of impact edges 30.

Figure 6:
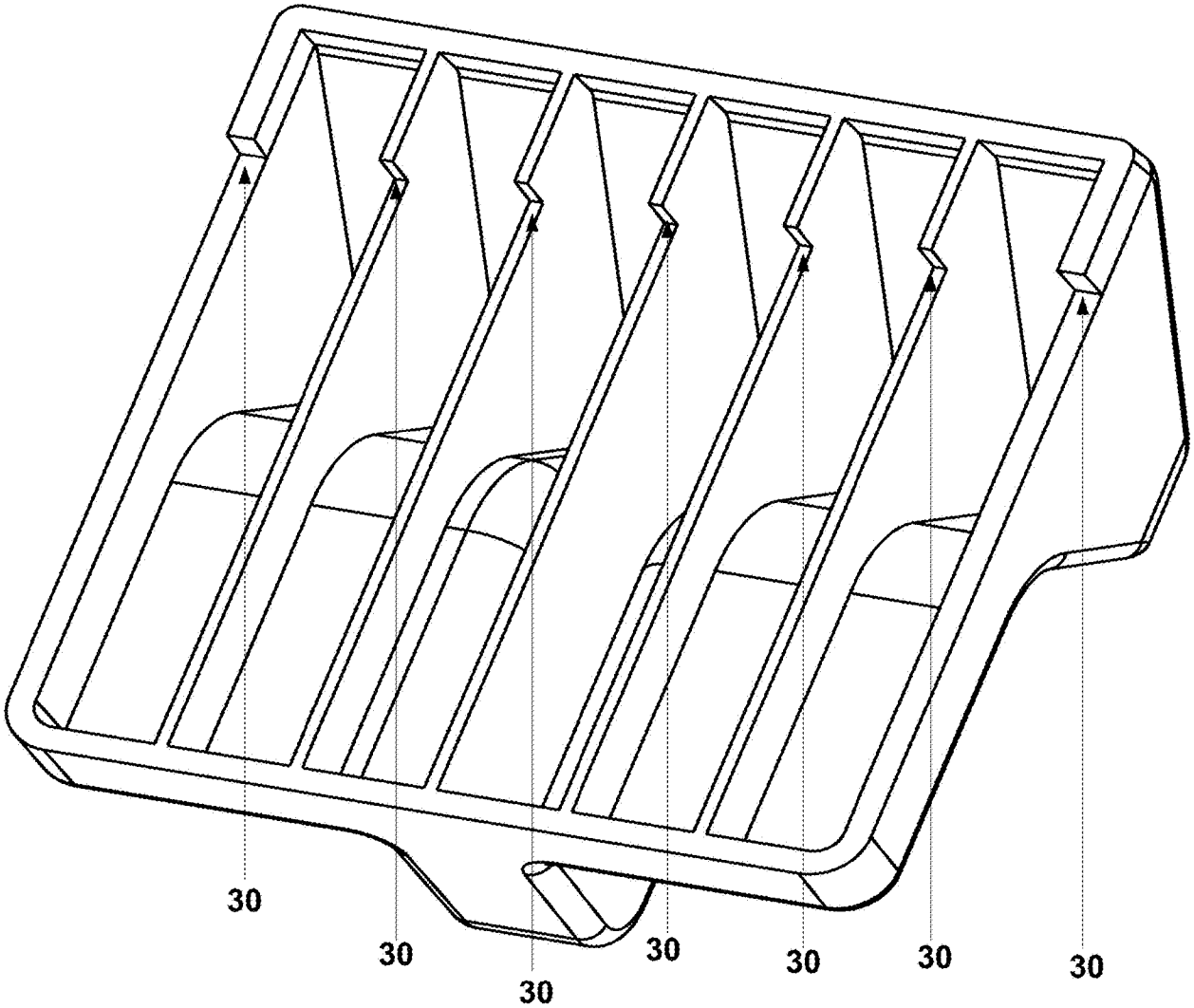
FIG. 6 is an alternative view showing a bottom of an exemplary floor installation tool.

FIG. 6 is an alternative view showing a bottom of an exemplary floor installation tool. FIG. 6 shows an alternative view of the underside of an exemplary floor installation tool, including a plurality of impact edges 30.

As highlighted by FIGS. 5 and 6, various exemplary floor installation tools include a relatively hollow underside. Additionally, the plurality of impact edges 30 are spaced relatively evenly apart in distance. Such features reduce overall weight and optimize the amount of force and the locations for the application of such force to the flooring material. In contrast, a solid underside and a continuous impact edge would increase the chances of damaging the flooring material, especially sensitive and/or less resistant flooring material.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

What is claimed:

1. A floor installation tool of unitary construction, comprising:

a base having a total length L 2, a total width W 1, and a plurality of pull bar slots;

a receded portion of the base having a length L 1;

a plurality of impact edges, each having a vertical height H 3 and forming an angle with the receded portion of the base, each impact edge of the plurality of impact edges configured to fit flush against a corresponding vertical side of a flooring material and transfer a force to the vertical side of the flooring material, the receded portion of the base configured to fit flush on a top of the flooring material, the plurality of impact edges being approximately evenly separated in distance apart on a bottom of the floor installation tool;

wherein L 1 is approximately 3.25 inches, L 2 is approximately 4.00 inches, H 3 is approximately .2165 inches, and W 1 is approximately 4.00 inches;

an underlying surface contact area configured to fit flush against an underlying surface being floored;

a strike plate forming an angle with a rounded nose, the strike plate configured for receiving a force for transfer to the plurality of impact edges; and a handle having a width W 2, wherein W 2 is approximately .75 inches.

2. The floor installation tool of claim 1, wherein the unitary construction is formed by any of: steel, metal, cast iron, aluminum, hardened plastic, or hardened rubber.

3. The floor installation tool of claim 1, wherein the strike plate is set at a ten degree angle.

4. The floor installation tool of claim 1, wherein each impact edge of the plurality of impact edges forms an approximate 90 degree angle to fit against the flooring material.

5. The floor installation tool of claim 1, wherein the plurality of impact edges transfer force to move the flooring material in a horizontal direction across the underlying surface.

6. The floor installation tool of claim 1, wherein the floor installation tool has a vertical height H 1 of approximately 1.75 inches when placed on top of the flooring material.

7. The floor installation tool of claim 1, wherein approximately .75 inches of the floor installation tool contacts the flooring material during use.

8. The floor installation tool of claim 1, wherein the rounded nose runs continuous to the strike plate.

9. The floor installation tool of claim 1, wherein the handle is defined by laterally adjacent scooped-out areas.

10. The floor installation tool of claim 9, wherein the handle extends from a top side, which is opposite of the strike plate to a horizontal surface that includes the plurality of pull bar slots.

11. The floor installation tool of claim 1, further comprising printed indicia.

* * * * *